United States Patent [19]

Strub et al.

[11] Patent Number: 5,024,049

[45] Date of Patent: Jun. 18, 1991

[54] BAND GUIDING AND FORMING ASSEMBLY FOR BANDING APPARATUS

[76] Inventors: Eric W. Strub, 235 Rockhill Rd., Vista, Calif. 92084; Kenneth M. Strub, 25670 Jesmond Dene, Escondido, Calif. 92026

[21] Appl. No.: 481,965

[22] Filed: Feb. 20, 1990

Related U.S. Application Data

[63] Continuation-in-part of Ser. No. 160,848, Feb. 26, 1988, Pat. No. 4,914,893.

[51] Int. Cl.[5] ..... B65B 9/13

[52] U.S. Cl. ..... 53/585; 53/567; 53/291

[58] Field of Search ..... 53/459, 551, 568, 567, 53/578, 585, 291, 298; 493/255, 258, 302

[56] References Cited

U.S. PATENT DOCUMENTS

| | | | |
|---|---|---|---|
| 2,565,846 | 8/1951 | Goodloe | 493/255 X |
| 3,304,844 | 2/1967 | Hosenfeld | 493/302 X |
| 3,594,975 | 7/1971 | Abrecht | 53/585 X |
| 3,681,892 | 8/1972 | Safranski | 53/551 |
| 3,802,152 | 4/1974 | Strub | 53/585 X |
| 4,102,728 | 7/1978 | Smith | 53/291 X |
| 4,118,915 | 10/1978 | Swenson | 53/291 |
| 4,412,876 | 11/1983 | Lerner | 53/585 X |
| 4,446,616 | 5/1984 | Waterman | 53/567 X |
| 4,545,181 | 10/1985 | Frankefort | 53/459 |
| 4,693,059 | 9/1987 | O'Donnell | 53/567 |
| 4,765,121 | 8/1988 | Konstantin | 53/567 X |

FOREIGN PATENT DOCUMENTS

| | | | |
|---|---|---|---|
| 1351156 | 4/1974 | United Kingdom | 53/567 |

*Primary Examiner*—John Sipos

*Attorney, Agent, or Firm*—Brown, Martin, Haller & McClain

[57] ABSTRACT

A band guiding and forming assembly for a banding machine includes an inner, free floating guide member for locating in the travel path of banding material through the machine and for positioning within the banding material to open it out, and outer opposed guide members on opposite sides of the travel path for supporting the inner guide member. At least one pair of opposed inner pinch rollers are rotatably mounted on opposite sides of the inner guide member for rotatably engaging opposed inner surface portions of the banding material, and a pair of opposed outer pinch rollers are rotatably mounted on the respective outer guide members for engaging and supporting the respective inner pinch rollers. Opposite surface portions of the banding material are rotatably engaged between the respective opposed inner and outer pinch rollers so that any crease lines between them are flattened out at least temporarily.

15 Claims, 4 Drawing Sheets

FIG. 4
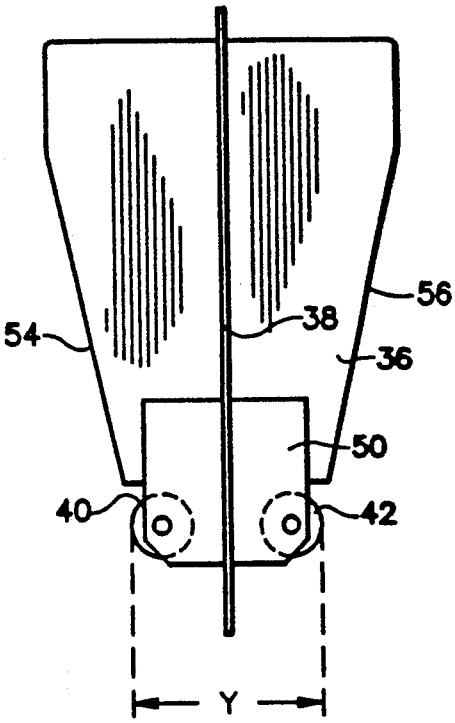
FIG. 5
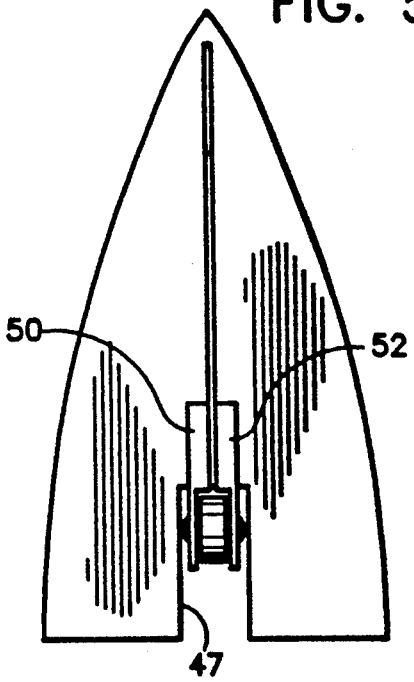
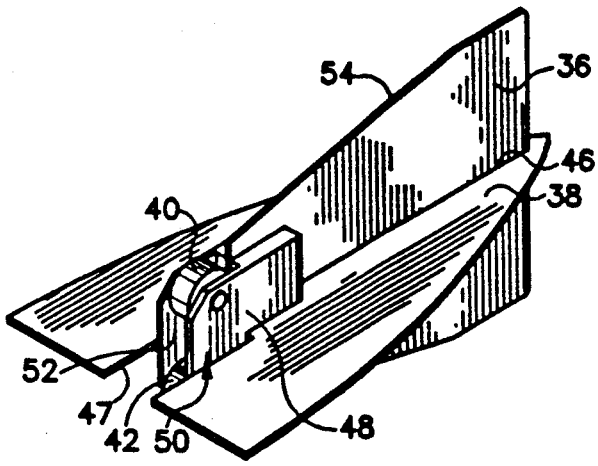
FIG. 6
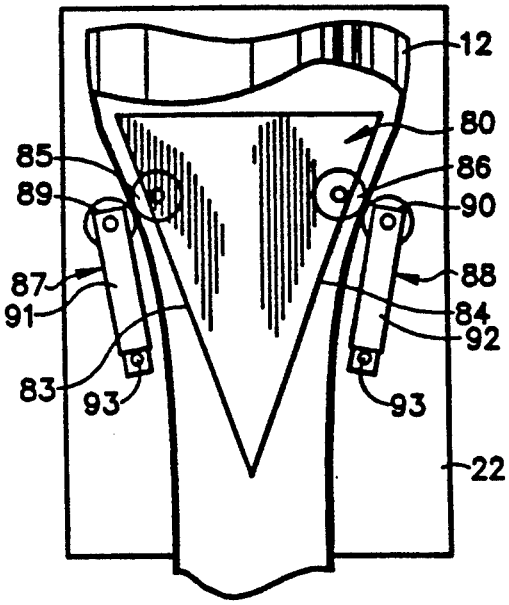
FIG. 7

BAND GUIDING AND FORMING ASSEMBLY FOR BANDING APPARATUS

CROSS-REFERENCE TO RELATED APPLICATIONS

This application is a continuation-in-part of Application Ser. No. 07/160,848 filed Feb. 26, 1988 for "Large Size Container Banding Apparatus", now U.S. Pat. No. 4,914,893.

BACKGROUND OF THE INVENTION

The present invention relates generally to apparatus for placing bands on containers and more particularly to a band guiding and forming assembly for such an apparatus, for receiving flattened plastic tubing material, opening it up and smoothing out the crease lines while guiding it along a predetermined path in the apparatus towards a cutting assembly for cutting the tubing into predetermined lengths and a device for guiding the cut lengths of tubing onto the necks of containers.

In U.S. Pat. No. 3,802,152 of Strub, a banding apparatus is described. The apparatus includes a forming apparatus for opening out a flattened banding sleeve and flattening the edge creases, in which the sleeve is passed over a ball, and a pair of pinch rollers having concavities are urged against the ball on opposite sides of the sleeve so that the pinched or creased edges of the sleeve are substantially pressed out as they pass between the ball and the rollers. One problem with this apparatus is that unless the crease lines are precisely positioned between the pinch rollers and ball, the desired smoothing out of the crease lines is not achieved. The tubing has a tendency to twist, resulting in the tubing still having a crease line when it passes to the cutting station, so that it will tend to close up after cutting. This makes it more difficult to position the cut bands around the neck of a container. Another disadvantage to this technique is that it is only appropriate for one size of tubing and is not easily adjustable for different diameter tubing, as may be needed where the same banding apparatus is used for banding various different size containers.

SUMMARY OF THE INVENTION

It is an object of this invention to provide an improved guiding and forming apparatus for opening out and smoothing the crease lines in tubular banding material, such as is used in banding machines.

According to the present invention, a band guiding and forming apparatus is provided for guiding tubular banding material along a travel path, which comprises an inner guide member extending along the travel path for locating inside the banding material, the inner guide member having opposed tapering edges or surfaces for gradually spreading the flattened tubing material into an open cylindrical condition, at least two inner opposed pinch rollers rotatably mounted on the inner guide member for rotatably engaging the interior surface of the tubing material, and at least two outer opposed pinch rollers rotatably supported on opposite sides of the travel path adjacent respective inner pinch rollers so as to rotatably engage respective opposed portions of the tubing material between the respective inner and outer rollers and to flatten out creases on the opposed portions passing between the pinch rollers.

The inner guide member is preferably a free, floating wedge assembly or member which is simply seated on the outer opposed pinch rollers after insertion into the hollow interior of the tubing material. In one embodiment of the invention the wedge member comprises a solid, tetrahedron shaped block having recesses in opposite side faces in which the inner pinch rollers are rotatably mounted so as to project outwardly from the surfaces on which they are mounted.

In an alternative embodiment, the wedge member comprises a pair of flat separation plates of similar or identical shape, each being of tapering width from a narrow end to a wide end. The plates are joined together at right angles along their respective central axes so that the wide end of one plate is adjacent the narrow end of the other plate, and vice versa. One of the plates is slotted along its central axis so that it can be fitted over the other plate at right angles and welded or otherwise secured in place. The opposed inner pinch rollers are rotatably mounted adjacent the narrow end of one of the plates facing in the direction of travel. The plates may be of any desired tapering shape, including triangular and paraboloid.

Preferably, opposed outer elongate guide members are mounted on opposite sides of the travel path for locating opposite sides of the inner guide member. The guide members preferably have V-shaped channels for locating the crease lines on a length of banding material passed over the inner guide member for aligning the crease lines with the pinch rollers. This arrangement positively guides the crease lines between the pinch rollers, and reduces or eliminates the risk of twisting of the material prior to arrival at the crease smoothing pinch rollers. The opposing inner and outer pinch rollers will tend to press out the crease lines as they are passed between them, with the combined effect of the tapering guide member and the opposed pinch rollers tending to open the tubing into a cylindrical, tubular condition, and substantially removes any "memory" of the creases, at least temporarily, so that the tubing will be less likely to collapse flat after cutting to length.

BRIEF DESCRIPTION OF THE DRAWINGS

The present invention will be better understood from the following detailed description of some preferred embodiments, taken in conjunction with the accompanying drawings, in which like reference numerals refer to like parts, and in which:

FIG. 4 is an enlarged front elevational view of the inner guide wedge member of the guiding and forming apparatus of FIG. 1;

FIG. 5 is a side elevation view of the wedge member of FIG. 4;

FIG. 6 is a perspective view of the wedge member of FIG. 4;

FIG. 7 is a front elevational view of a band guiding and forming apparatus according to a second embodiment of the invention;

DESCRIPTION OF THE PREFERRED EMBODIMENTS

Figure 1:
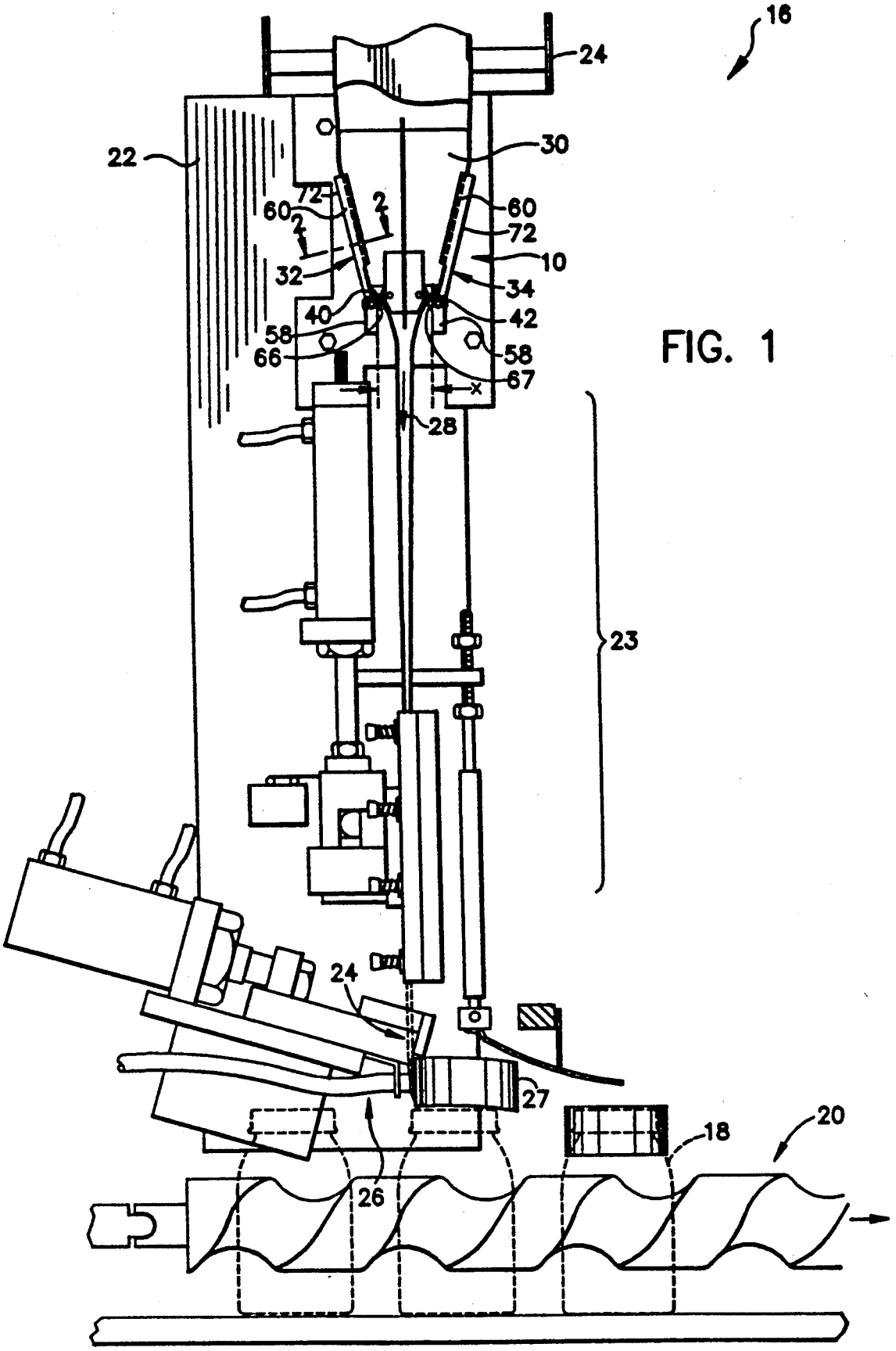
FIG. 1 illustrates a front elevational view of a banding machine including a band guiding and forming apparatus according to a first embodiment of the present invention.

FIG. 1 of the drawings illustrates a banding machine incorporating a band guiding and forming assembly or apparatus 10 according to a first embodiment of the present invention for feeding tubular banding material 12 from a feed roller 14 along a predetermined feed path into banding apparatus 16. The apparatus 10 is suitable for use in any type of banding apparatus for cutting banding material into lengths and mounting it on the necks of a series of containers 18, and is shown by way of example only in FIG. 1 mounted on a banding apparatus as described in our co-pending application Ser. No. 07/160,848 filed Feb. 26, 1988, which is incorporated herein by reference. It will be understood that the guiding and forming apparatus 10 may alternatively be mounted at the inlet end of any banding machine.

As illustrated in FIG. 1, the banding apparatus or machine 16 is mounted above a suitable conveyor 20 for feeding a series of upright containers 18 beneath the outlet end of the machine 16. The various components or stations of the machine 16, including the guiding and forming apparatus 10, are mounted on a back support plate or wall 22 typically used in banding machines for holding or supporting many of the mechanical components used in the machine, and may be enclosed within an outer housing (not illustrated in the drawings). The other stations will not be described in detail here since they form no part of the present invention, but they basically comprise a feed mechanism 23 for driving the banding material along the travel path, a cutting mechanism 24 below the apparatus 10 in which the opened banding material is cut to length, and a deposition station 26 in which the cut bands 27 are deposited onto the necks of successive containers 18.

As mentioned above, the band guiding and forming apparatus 10 is mountable on the main back plate of the banding machine so as to extend in the band travel direction or path 28, as best illustrated in FIGS. I and 3. The apparatus 10 basically comprises an inner, free floating guide member or device 30 for positioning within the banding material, and a pair of opposed outer guide members 32,34 on opposite sides of the travel path 28 which support the inner guide device 30 so that opposed surface portions of the banding material are pulled by the feed mechanism between the respective opposed surfaces of the inner and outer guide members.

The inner guide member is illustrated in more detail in FIGS. 4 to 6 and basically comprises a pair of crossed, perpendicular flat plates or fin members 36,38 of generally triangular shape, one of the plates 36 having a pair of opposed, inner pinch rollers 40,42 rotatably mounted on its opposite edges adjacent its narrowest end. The plates are interlocked and secured together by means of a slot 46 extending along the central axis of plate 38 from the widest end towards its narrowest end, the first plate 36 being inserted centrally into the slot with its widest end located adjacent the narrowest end of plate 38. The two plates are secured together in any suitable manner, such as friction fitting, welding, soldering or adhesive bonding.

As illustrated in FIGS. 4 to 6, the inner pinch rollers 40 and 42 are mounted on the plate 36 via mounting assembly 48 which is located in an enlarged end portion 47 of slot 46. Mounting assembly 48 comprises a pair of slotted support plates 50,52 suitably secured to opposite side faces of plate 36 at its narrowest end and slotted over the plate 48, as best illustrated in FIG. 6. The rollers 40 and 42 are rotatably mounted between the support plates on opposite sides of plate 38 so that their outermost portions are located substantially in alignment with the respective outer side edges 54,56 of plate 36 (see FIG. 4).

Figure 2:
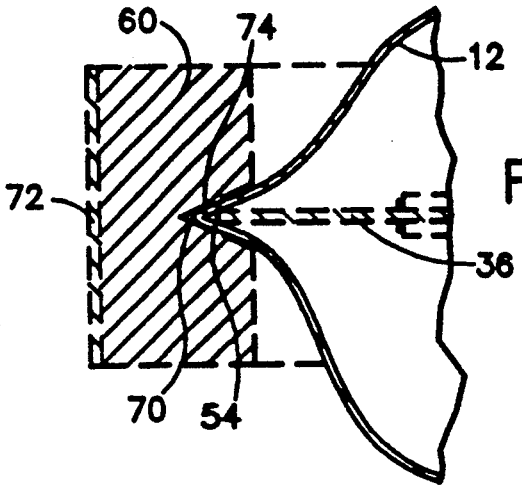
FIG. 2 is an enlarged cross-section on the lines 2—2 of FIG. 1.
Figure 3:
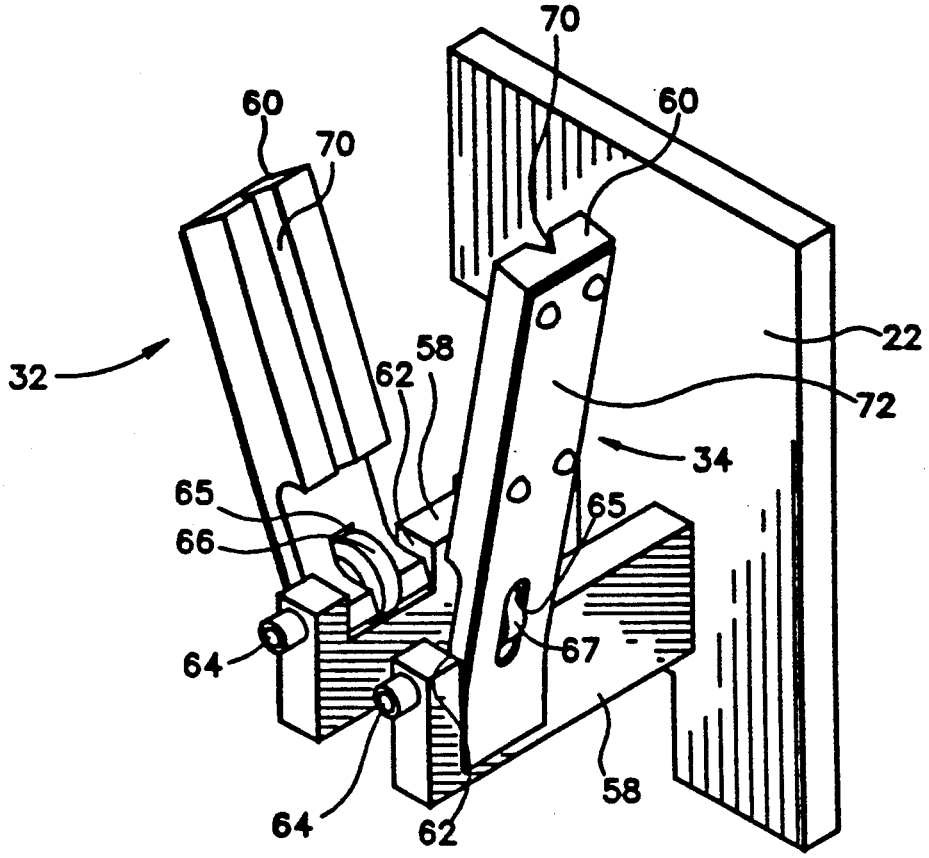
FIG. 3 is a perspective view illustrating the mounting of the outer guide arms of the forming apparatus of FIG. 1.
Figure 8:
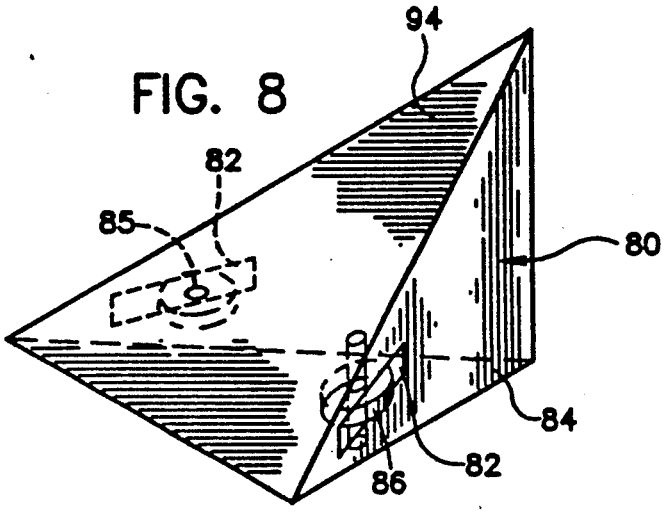
FIG. 8 is a perspective view of the inner guide wedge member of FIG. 7.
Figure 9:
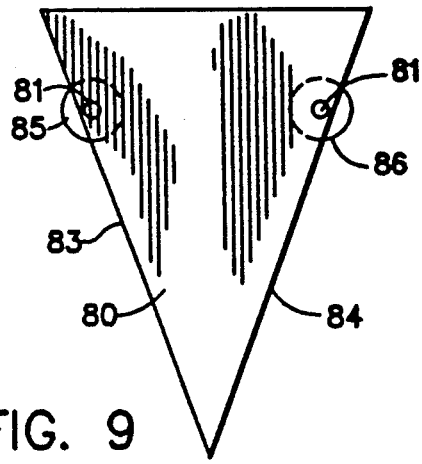
FIG. 9 is an enlarged front elevation view of the wedge member for use in the apparatus of FIG. 7.
Figure 10:
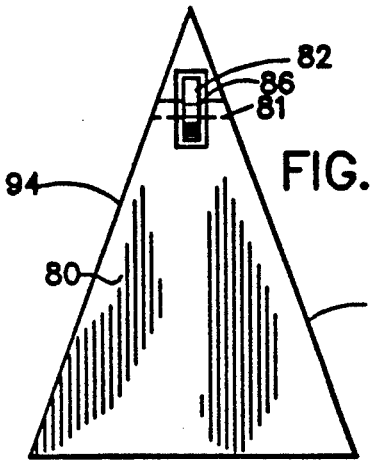
FIG. 10 is a side elevation view of the wedge member of FIG. 9.

The outer guide members 32,34 will now be described in more detail with reference to FIGS. 1 to 3. The guide members are arranged to face one another and have equivalent parts which are either identical or mirror images of one another, and like reference numerals have been used for equivalent parts where appropriate. Each guide member basically comprises a fixed support arm 58 which is suitably bolted or otherwise secured at one end to back plate 22 so that it projects transversely outwardly from the back plate on a respective side of the travel path, and an elongate guide arm 60 which is pivotally mounted at one end in an upwardly facing slot 62 in support arm 58 via pivot pin 64 which extends through aligned openings in the support arm and end of the guide arm, as best illustrated in FIG. 3. The guide arms also each have a slot 65 at their lower end in which an outer pinch roller 66, 67 respectively, is rotatably mounted on pin 64. Each arm 60 has a generally V-shaped, inwardly facing channel 70 extending from its upper end towards its lower end, which acts to locate the opposite side edges of the plate 36 of inner guide member when seated on the outer guide members, as illustrated in FIGS. 1 and 2. The respective opposite guide arms 70 are biassed inwardly by means of spring plates or leaf springs 72 of spring steel or the like acting on their outer surfaces, as best illustrated in FIG. 3.

The dimensions of the inner guide member are selected according to the diameter of the tubing to be used. Preferably, the maximum dimension of the guide member is approximately equal to the tubing lay flat width. The guide member is inserted into the end of the tubing with its opposite side edges aligned with the respective opposite crease lines 74 of the tubing, so that the crease lines travel over the inner guide rollers. The inner wedge or guide member is then seated on the outer guide members with the opposite side edges 54 and 56 engaged in the respective channels 70. The guide member will slide downward under gravity until the opposite, inner pinch rollers 40,42 are seated on the opposed outer pinch rollers 66,67, respectively, as illustrated in FIG. 1. The innermost portions of the outer pinch rollers are separated by a distance slightly less than the separation between the outermost edges of the inner pinch rollers. In other words, the distance X in FIG. 1 is less than the dimension Y in FIG. 4, so that the inner guide member will be supported on the outer pinch rollers and positioned by the guide channels 70.

The crease lines 74 will be located outside the respective side edges 54 and 56 of plate 36 and within the innermost ends of the V-shaped channels 70, which are biased inwardly by spring plates 72, as best illustrated in FIG. 2, to resist any tendency of the tubing to twist. Thus, as the tubing is pulled through the guide apparatus 10 by the feed mechanism, the crease lines will be pressed between the respective inner and outer rollers, which tends to flatten or smooth out the fold or crease lines. At the same time, the tubing will be gradually opened out by the widening of the perpendicular cross plate 38, enhancing the spreading or flattening of the crease lines. During the short length of time it takes for the plastic banding material to travel from the forming apparatus 10 through the remainder of the banding machine, the crease lines will tend to expand or fold open and the material will tend to assume an open, cylindrical configuration so that it can be easily deposited onto the containers.

This forming apparatus will therefore reduce or eliminate any tendency of the banding material to twist so that the crease lines are no longer located between the pinch rollers, and positively retains the crease lines in the desired path in alignment with the pinch rollers.

The apparatus described above can also be easily adjusted for different diameter banding materials. A series of wedge or inner guide members of different dimensions are provided, from the smallest to the largest diameter tubing to be used in the banding machine. A wedge member having a larger maximum width than that illustrated in the drawings would simply bias the guide arms outwardly from the position illustrated in FIG. 1. A wedge member of smaller dimensions would allow the guide arms to be biassed inwardly from the position illustrated in the drawings by the flexed spring plates. In each case, the inner pinch rollers 40,42 interact with the respective opposing outer crease rollers 66,67, respectively, to press the crease as the tubing is pulled between them, in a procedure known as "counterfolding".

The flat plates forming the wedge member or members are of any suitable material, such as thin aluminum or stainless steel plates of the order of 0.030 to 0.0625 inches thick. It is desirable to provide a material which has a thin profile but which will withstand long term exposure to surface abrasion. The plates are preferably generally triangular in shape as illustrated, although other shapes such as parabolic may be used, with the channels 70 being shaped accordingly to match the shape of the outer side edges of plate 36.

FIGS. 7 to 10 illustrate an alternative embodiment of the band guiding and forming or opening assembly in which the inner guide member comprises a solid tetrahedron shaped wedge member 80 having recesses 82 on opposite side walls 83,84 in which inner pinch rollers 85,86 are rotatably mounted on pivot pins 81 which project through the recesses. The rollers 85,86 project partially outwardly from the respective side walls of the block (see FIGS. 7 and 9). The block is freely seated on outer opposed guide members 87,88 so that the side walls of the block carrying the inner pinch rollers taper inwardly in the downward or band travel direction (see FIG. 7). The outer guide members 87,88 are supported on the back plate 22 of a banding machine. Each outer guide member 87,88 comprises an outer pinch roller 89,90 rotatably mounted on the end of a roller support bracket 91,92 which is suitably supported by screw fasteners 93 or the like on the back wall or plate 22 of the machine. By loosening one or both of the screw fasteners 93, the brackets can be rotated to locate the pinch rollers 89,90 closer or farther apart, to accommodate different diameter tubing material 12.

In use, the wedge member 80 is inserted into the end of the tubing material and positioned so that the inner pinch rollers 85,86 rest on the respective outer pinch rollers 89,90. The wedge member 80 has a maximum width greater than the spacing between rollers 89 and 90, and will ride or slide down under gravity until the inner rollers 85,86 press down on the outer rollers, trapping the tubing material 12 between them as illustrated in FIG. 7. The tubing material is located so that the opposite crease lines are positioned between the opposing faces of the inner and outer pinch rollers. As the tubing material is pulled through the forming apparatus by the feed mechanism, the outwardly tapering walls 94,95 of the wedge (see FIGS. 8 and 10) act to open out the material while the inner pinch rollers on the other walls press the banding material flat against the opposing outer pinch rollers, temporarily flattening out the fold or crease lines. The banding material will tend to assume a cylindrical configuration, and the crease lines will retain the tendency to open out during the short tile it takes to travel to the remainder of the banding machine.

This apparatus can be easily modified to accommodate banding material of different diameter, by selecting a wedge member of appropriate dimensions having a maximum width dimension substantially equal to the banding material lay flat width, and by loosening fasteners 93 and suitably adjusting the spacing between the outer pinch rollers to be slightly less than the spacing between the inner pinch rollers on the selected wedge.

Although only a single pair of inner and outer opposed pinch rollers is illustrated in each of the described embodiments, additional pairs of opposed pinch rollers may be provided at spaced locations on the inner and outer guide members if desired or needed to reduce drag and aid in smoothing out crease lines.

The opposing inner and outer pinch rollers act both to smooth out the crease lines and also to reduce the tendency of the material to stick or drag against the surfaces of the wedge member, which could potentially cause twisting. The wedge member acts both to open out the material and to smooth out or substantially flatten the crease lines, at least temporarily. In the first embodiment of the invention, the outer guide channels also act to positively locate the crease lines in alignment with the opposing pinch rollers and to resist any tendency of the material to twist, so that the material is guided from the outside rather than from only the inside.

Although some preferred embodiments of the present invention have been described above by way of example only, it will be understood by those skilled in the field that modifications may be made to the disclosed embodiments without departing from the scope of the invention, which is defined by the appended claims.

We claim:

1. A band guiding and forming apparatus for opening and smoothing flattened tubular banding material having opposing creased lines, comprising:

guide means for opening out and guiding tubular banding material along a travel path;

the guide means including inner guide means extending along the travel path for positioning inside the tubing material, an outer opposed guide means on opposite sides of the travel path for supporting the inner guide means and for guiding opposed portions of the tubing walls between the inner and outer guide means;

the inner guide means comprising a wedge-like member having a first pair of opposed tapering portions of substantially continuously and uniformly reducing width extending along substantially the whole length of the wedge-like member in the travel direction contacting the band within said crease lines and a second pair of opposed tapering portions extending alongside the first pair of tapering portions in a plane perpendicular to said first pair and of substantially continously and uniformly increasing width extending along substantially the whole length of the wedge-like member in the travel direction for gradually spreading and opening the tubing material, and a pair of opposed inner pinch rollers, each inner pinch roller being mounted on a respective one of said first pair of opposed tapering portions for rotatably engaging respective opposed interior surface portions of said crease lines; and the outer guide means including a pair of opposed outer pinch rollers located on opposite sides of the travel path adjacent respective ones of said inner pinch rollers for rotatably engaging opposite surface portions of said banding material and pressing said portions between respective inner and outer pinch rollers for flattening and smoothing said crease lines between said rollers.

2. The apparatus as claimed in claim 1, wherein said inner guide means comprises a solid, tetrahedron shaped block and said inner rollers are rotatably mounted on opposed faces of said block which taper inwardly in the travel direction.

3. The apparatus as claimed in claim 1, wherein said inner guide means is a free, floating member and said outer guide means comprises means for freely supporting said inner guide means.

4. The apparatus as claimed in claim 1, wherein the maximum width of said inner guide means is substantially equal to the tubing lay flat width.

5. The apparatus as claimed in claim 4, including a plurality of inner guide members of varying dimensions for fitting inside tubing of different diameters.

6. The apparatus as claimed in claim 5, wherein said outer pinch rollers are adjustably mounted to accommodate inner guide members of different dimensions.

7. A band guiding and forming apparatus for opening and smoothing flattened tubular banding material, comprising:

guide means for guiding and opening out tubular banding material traveling along a travel path;

the guide means including inner guide means extending along the travel path for positioning inside the tubing material, and outer opposed guide means on opposite sides of the travel path for supporting the inner guide means and for guiding opposed portions of the tubing walls between the inner and outer guide means;

the inner guide means comprising a wedge-like plate having flat surfaces with a pair of opposed tapering portions of reducing width in the travel direction, and a pair of opposed inner pinch rollers; and the outer guide means including a pair of opposed outer pinch rollers located on opposite sides of the travel path adjacent respective ones of said inner pinch rollers for rotatably engaging opposite surface portions of said banding material between respective outer and inner pinch rollers so as to flatten and smooth any crease lines between said rollers;

said first pair of opposed surface portions comprising tapering linear edges for locating the internal sides of opposite crease lines on said banding material each said inner pinch roller being rotatably mounted on a respective one of said opposed tapering portions perpendicular to said flat surfaces for rotatably engaging respective opposed interior surface portions of said banding material.

8. The apparatus as claimed in claim 7, wherein said outer guide means further includes opposed, outer elongate guide members extending on opposite sides of the travel path adjacent the respective opposite tapering edges, said guide members having channels for guiding said crease lines between each respective outer guide member and inner tapering edge.

9. The apparatus as claimed in claim 8, wherein said channels are V shaped.

10. The apparatus as claimed in claim 8, wherein said outer pinch rollers are rotatably mounted at the end of said guide channels with the gap between each pair of inner and outer pinch rollers in alignment with the respective channel.

11. The apparatus as claimed in claim 8, further including support means for supporting said guide members, and mounting means for adjustably mounting said guide members on said support means.

12. The apparatus as claimed in claim 11, including biasing means for urging each guide member inwardly against the respective opposed tapering edge.

13. The apparatus as claimed in claim 7, wherein said inner guide means includes a second flat plate of tapering width, one of said plates having a slot extending along at least a major portion of its central axis and engaging over the other plate so that the plates are perpendicular to one another with their central axes coinciding, the wide end of the first plate being adjacent the narrow end of the second plate, and said inner pinch rollers being mounted on the respective opposite edges of said first plate.

14. A band guiding and forming apparatus for opening and smoothing flattened tubular banding material, comprising:

inner guide means extending along part of a travel path for tubular banding material for positioning inside and opening the tubular banding material as it travels along the path, and outer opposed guide means on opposite sides of the travel path for supporting the inner guide means and for guiding opposed portions of the tubing walls between the inner and outer guide means;

the inner guide means comprising first and second flat plates of tapering width secured together perpendicular to one another along their center lines so that they taper in opposite directions with the wide end of the first plate adjacent the narrow end of the second plate and the first plate being of reducing width in the travel direction;

a pair of opposed inner pinch rollers rotatably mounted on respective opposite portions of the opposite edges of the first plate for rotatably engaging respective opposed interior portions of said banding material; and the outer guide means including a pair of opposed outer pinch rollers located on opposite sides of the travel path adjacent respective ones of said inner pinch rollers for rotatably engaging opposite surface portions of said banding material between respective inner and outer pinch rollers so as to flatten and smooth any crease lines between said rollers.

15. The apparatus as claimed in claim 14, wherein said outer guide means includes opposed outer elongate guide members extending on opposite sides of the travel path, said outer elongate guide members being inclined towards one another at angles equivalent to the angle of taper of said first plate and having channels extending along their length for receiving the opposite tapering edges of said first plate and for guiding said crease lines between each respective edge of the plate and guide member channel, said inner and outer opposed pinch rollers being located at the end of said channels.

* * * * *